US005832563A

United States Patent [19]

Simpson

[11] Patent Number: 5,832,563

[45] Date of Patent: Nov. 10, 1998

[54] FOREARM ASSISTANT DEVICE

[76] Inventor: Ronald Keith Simpson, 4813 Nicely Town Rd., Clifton Forge, Va. 24422

[21] Appl. No.: 816,931

[22] Filed: Mar. 13, 1997

Related U.S. Application Data

[60] Provisional application No. 60/018,453, May 28, 1996.

[51] Int. Cl.[6] ..... A47B 95/02

[52] U.S. Cl. ..... 16/110 R; 294/25

[58] Field of Search ..... 16/110 R, 111 R, 16/114 R, 113, DIG. 12, DIG. 41; 294/25, 58; 81/177.2, 177.1, 489, 427.5

[56] References Cited

U.S. PATENT DOCUMENTS

| | | | |
|---|---|---|---|
| 2,482,589 | 9/1949 | Maguire | 294/59 |
| 2,710,571 | 6/1955 | Pfister | 294/57 |
| 4,196,742 | 4/1980 | Owen | 135/71 |
| 4,813,458 | 3/1989 | Jacobucci | 15/236.02 |
| 4,888,846 | 12/1989 | Natale | 15/236.01 |
| 4,924,924 | 5/1990 | Stewart | 16/114 R |
| 4,962,561 | 10/1990 | Hamilton | 15/111 |
| 5,156,429 | 10/1992 | Adams | 294/25 |
| 5,379,758 | 1/1995 | Snyder | 16/110 R |
| 5,455,981 | 10/1995 | Wiese | 15/236.01 |
| 5,471,700 | 12/1995 | Pereira | 15/160 |
| 5,529,357 | 6/1996 | Hoffman | 294/58 |
| 5,564,451 | 10/1996 | Hagberg | 135/68 |
| 5,669,650 | 9/1997 | Rutz | 294/58 |

*Primary Examiner*—Chuck Y. Mah
*Attorney, Agent, or Firm*—Donavon Lee Favre

[57] ABSTRACT

The present invention is directed to a fore-arm assistant device. The device has a frame which encircles at least part of a forearm of a user. A cuff is positioned on one end of the frame so as to encircle the forearm adjacent to the elbow of the user. A handgrip extends from one side of the frame to the other side of the frame and is positioned approximately the length of the forearm from the elbow end of the frame. A tubular locking member is positioned on the other end of the frame. Various tools, a crutch leg or a kayak paddle can be held in the device.

12 Claims, 6 Drawing Sheets

30
10
27
24
28
38
40
12
14

26
42
44

26

14
16
18

20
22

16
20

FOREARM ASSISTANT DEVICE

CROSS REFERENCE TO RELATED APPLICATIONS

Priority is hereby claimed based upon Provisional Application 60/018,453 filed 28 May 1996 by Ronald Keith Simpson, the same inventor as the present application.

FIELD OF THE INVENTION

The forearm assistant device of the present invention is designed to help anyone who is unable to use one arm, or who has only one arm. It can be used for household work such as sweeping and mopping, gardening work, paddling a canoe or kayak, or painting. The device can also be used as a forearm crutch.

BACKGROUND OF THE INVENTION

Tools such as mops, rakes, spades, paint rollers, window washing squeegees or the like are designed for persons with two usable arms. Such tools have an extended shaft by which the tool is gripped with both hands. There are disadvantages in the use of such tools even for persons without disabilities. In fact the use of such tool can, according to some prior art, lead to disabilities. Efforts to improve the holding and manipulation of prior art tools include the following.

U.S. Pat. No. 2,482,589 Maguire (1949) is directed to the combination of a rod having a handle on one end and a forearm encircling ring at the other end. Clamps extending from the rod detachably connect an implement to the body member. This allows the user to sweep with one hand-arm combination and use a dust pan with the other hand-arm combination. Force against the arm is concentrated in a very narrow region under the rod.

U.S. Pat. No. 4,196,742 Owen (1980) discloses a ski-pole or crutch provided with a forearm yoke at its upper end and a pistol grip positioned below it. Both the pistol grip and the yoke face rearward so that when the pistol grip is held in one hand the yoke can be swung into and out of locking engagement with the upper side of the forearm simply by bending the wrist, thereby providing greater maneuverability of the pole and support of the arm when needed for balance, support of the body and steering by planting the pole or dragging it. There is no locking engagement except when the arm is bent forward.

U.S. Pat. No. 4,813,458 Jacobucci (1989) discloses a tool for scraping ice from a vehicle's windshield. The tool has a center handle which acts as a fulcrum, and two lever arms which act as lever arms, which incurve and join each other to form the forearm rest at the rear extremity of the unit. Again pressure on the arm is concentrated in a very narrow region.

U.S. Pat. No. 4,888,846 Natale (1989) discloses an asbestos scraping assembly. The arm of the operator is cradled in a scraper extension bracket so as to apply greater force to a scraper blade with less effort by the operator than is required of a hand-held scraper blade. The bracket encircles the forearm half way between the wrist or the elbow which is not very cushioned with muscle or in the case of a rod contacts a narrow area of one side of the upper forearm.

U.S. Pat. No. 4,962,561 Hamilton (1990) discloses a scraper having a handle with a looped section which engages the upper forearm adjacent the elbow. Again force is directed to a narrow region of the arm.

U.S. Pat. No. 5,355,981 Wiese (1995) discloses a scraper with a lever arm extending at a right angle to the handle and having an opening to permit insertion of a users forearm. An arm cradle has a padded arcuate shape for engaging a crosswise portion of the users forearm. Only a narrow portion of the lower forearm is contacted.

U.S. Pat. No. 5,471,700 Pereira (1995) is directed to a handle for grill cleaning tools. The handle has an inverted U-shaped portion sized to next over the lower forearm to apply downwardly directed forces on the distal end of the working head portion. A recess in the lower surface of the working head is structured to receive grill cleaning tools for removable attachment to the handle. Again pressure is applied to a narrow band of the lower forearm. Wing nuts are used to hold various grill cleaning tools in place.

U.S. Pat. No. 5,529,357 Hoffman (1996) discloses a leverage enhancing assembly for attachment to the handle of a mop, broom, rake or similar tool which has an elongate handle. The assembly has an arm clamp for securing the assembly to a single arm of the user and a grasping shaft for grasping the assembly handle. The arm clamp is comprised of a first rigid longitudinal segment adjustably attached to the end of the assembly proximate to the user by a semi-rigid clamp having an adjustable circumference. The grasping shaft comprises a second rigid longitudinal segment attached to the tool handle by a semi-rigid clamp opposite the user relative to the arm clamp and in axial alignment with the arm clamp. This second longitudinal segment is further configured to be adjustably matable to the first longitudinal segment. The arm clamp exerts constant pressure on the upper forearm which could reduce blood circulation. A series of clamps tightenable by screws appear to be positioned along the length of the assembly for the attachment of a tool handle to the assembly. There is also the possibility that the patent was filed after many features of the present invention were invented.

SUMMARY OF THE INVENTION

The present invention is directed to a forearm assistant device which allows a handicapped person to do with one arm tasks which normally require two arms, such as paddling a kayak, or working with tools normally having long handles. The device has a frame which encircles at least part of a forearm of a user. A wide cuff positioned on the upper forearm end of the frame so as to encircle the forearm adjacent to the elbow of the user. The cuff has a width of at least two inches and is padded to decrease localized pressure on any part of the upper forearm. The width of the cuff can extend from the upper forearm to below the hand, completely encircling the entire forearm in which case the padding would be placed on the inner surface of the cuff encircling the upper forearm. A handgrip extends from one side of the frame to the other side of the frame and is positioned approximately the length of the forearm from the elbow end of the frame. A tubular locking member is positioned on a tool holding end of the frame. The tubular locking member has an inner tapered compressible tube having external threads and longitudinal slits perpendicular to the threads and an outer tapered tube element having internal threads positioned on the inner tapered tube element whereby rotation of the outer tube element in one direction will compress the inner tube element and rotation of the outer tube in the other direction will expand the inner tube element. The locking member has the trademark STAY-LOCK and is the product of the Structron Company.

Each end of the handgrip is attached to an opposite side of the frame, and the attachment means is adjustable to vary the distance of the handgrip from the forearm end of the frame to accommodate individuals having different forearm lengths. The attachment means can be positioned in reinforcing strips positioned on opposite sides of the frame. The attachment means can be resilient grommets having radial openings for the insertion of handle ends, or the reinforcing element can be slidably mounted in the frame and locked into place with screws or clamps. If the forearm assistant device is custom made for an individual, there is no need to adjust the distance of the handgrip from the forearm end of the device.

A cushion is positioned on the inner surface of the cuff adjacent the forearm end of the device. The cushion encircles the arm of the user and extends at least two inches from the forearm end. The inner diameter of the cushion is preferably larger in diameter than the forearm of the user so as not to exert pressure on the forearm when the device is not in active use. Pressure on the forearm is intermittent when the device is in active use producing a massaging effect. The cushion is preferably attached to the inner surface of the device with a VELCRO™ attachment.

The frame is preferably made of a resilient material so as to protect the user in case of a fall or if the frame accidentally strikes something while the user is working. A shield can be positioned on the tool end of the frame if the user is working in brush or is subject to flying debris such as hot ashes from a fire. The device can also be used to work through a small opening in an enclosure.

The fore-arm assistant device of the present invention can also be used as a forearm crutch. When used as a forearm crutch a rod is firmly held in the tubular locking member. As a safety measure when used as a forearm crutch a common pin extends though both the rod and the frame to ensure that the rod does not slip in locking member. More preferably two pins are used, one pin below the locking device extends through the frame and the rod and a second pin above the locking device extends through the rod and the frame. Also as a safety feature the inner tube of the locking device is attached to the frame with a safety wire to prevent any possibility of the inner tube striking the hand of a user in case of the locking device coming loose from the frame. The inner tube of the locking device has two parts. The first part is a threaded tubular compressible part and the second part is a glass fiber reinforced plastic tubular extension.

A tubular shim can be positioned between the locking device and a tool handle to compensate for diameter differences between the inner diameter of the tubular locking member and the outer diameter of the tool handle.

The locking device is obtained from Structron, Inc and is an extension tube attached to a locking device. The unit is called a STAYLOCK locking device. In the manufacture of the forearm assistant device, holes are drilled in the extension tube and the frame is molded around the extension tube and material from the frame flows into the extension tube.

BRIEF DESCRIPTION OF THE DRAWINGS

FIG. 14 is a view of the forearm assistant device having two paddles attached for use with a kayak.

DESCRIPTION OF THE PREFERRED EMBODIMENTS

Figure 1:
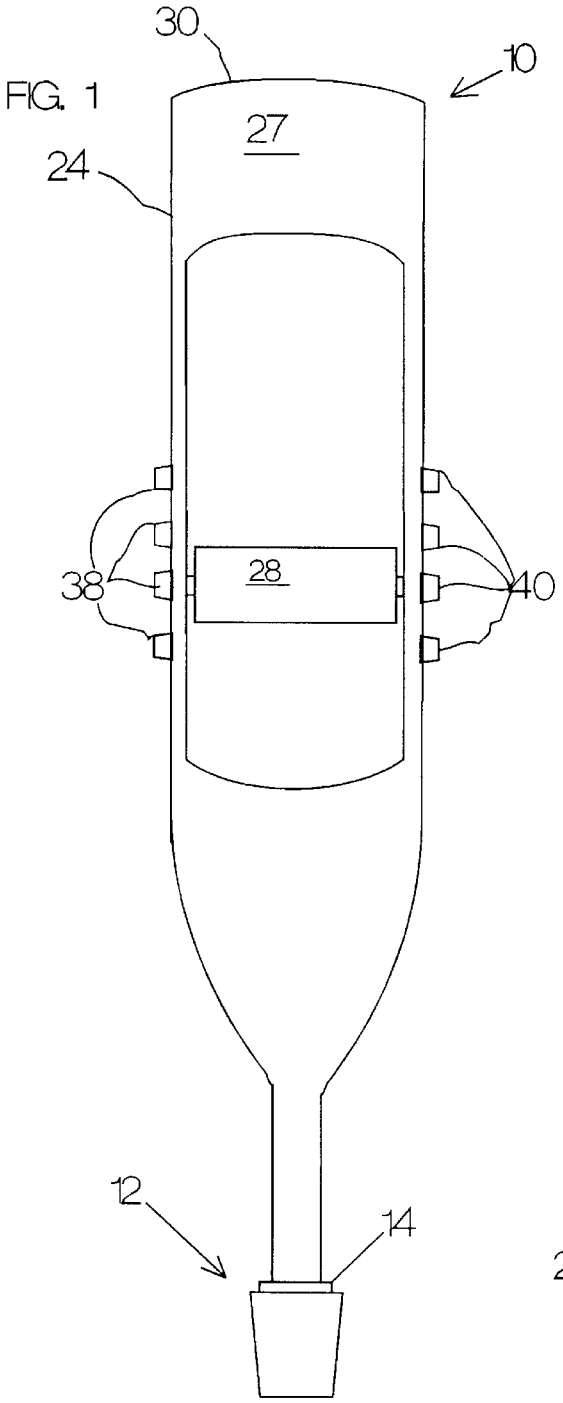
FIG. 1 is a side view of the forearm assistant device.

Turning now to the Figures, certain embodiments of the present invention will now be described. FIG. 1 is a view of the forearm assistant device 10 of the present invention. The forearm assistant device is designed for retrofit to an existing tool designed for a person with two good arms, to adapt the tool for use by a person with one good arm. Thus a person with one good arm can paddle a kayak using a double paddle kayak paddle or work with tools normally having long handles.

Figure 2:
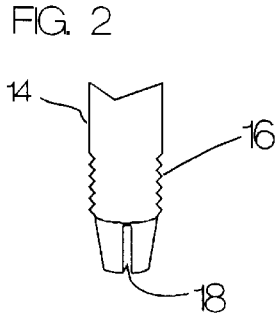
FIG. 2 is a view of the inner part of a tubular locking member.
Figure 3A:
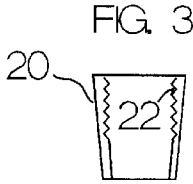
FIG. 3*a* is a view of the outer part of a tubular locking member.
Figure 3B:
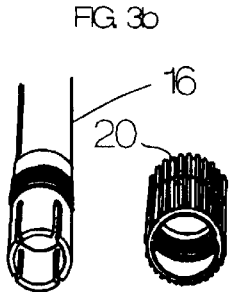
FIG. 3*b* is a perspective view of both the inner and out parts of the tubular locking member.

A tubular locking member 12 is positioned on the lower end of the device 10. The tubular locking member 12 as shown in FIGS. 2, 3*a* and 3*b* has an inner tapered compressible tube 14 having external threads 16 and longitudinal slits 18 perpendicular to the threads which allow for the compressibility of tube 14. As shown in FIG. 3*a* which is a sectional view of the outer tapered tubular locking element 20 of tubular locking member 12, the outer tapered tube element has internal threads 22 whereby rotation of the outer tube element in one direction will compress the inner tube 14 and rotation of the outer tube in the other direction will expand the inner tube 14. The locking member 12 has the trademark STAYLOCK and is the product of the Structron Company.

Figure 4:
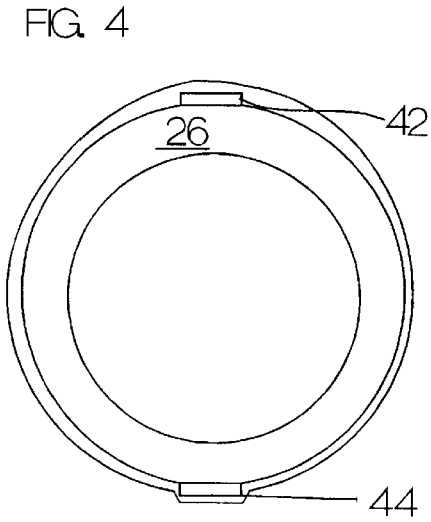
FIG. 4 is a sectional view the cuff of the device.
Figure 5:
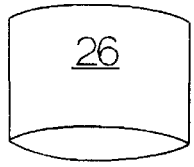
FIG. 5 is a perspective view of a resilient cuff liner.

The device has a frame 24 which encircles at least part of a forearm of a user. A wide forearm cuff liner 26 of a resilient foam or other padding having a width of at least one half inch and preferably a width of from one to four inches and a thickness is positioned on the inside of the upper forearm end of the frame 24, the forearm cuff 27 so as to encircle the forearm adjacent to the elbow of the user. (See FIGS. 4 and 5) The foam or padding 26 has a thickness of preferably one fourth to one half inch. The cuff liner 26 most preferably has a width of at least two inches and is padded to decrease localized pressure on any part of the upper forearm. The width of the cuff liner 26 can extend from the upper forearm to below the hand, completely encircling the entire forearm in which case the padding 26 would be placed on the inner surface of the cuff 27 encircling the upper forearm.

Figure 6:
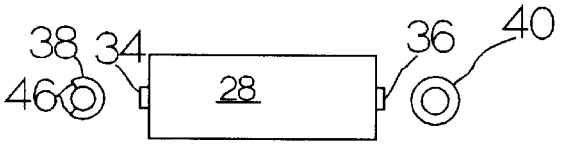
FIG. 6 is a view of the handgrip and corresponding grommets.
Figure 7:
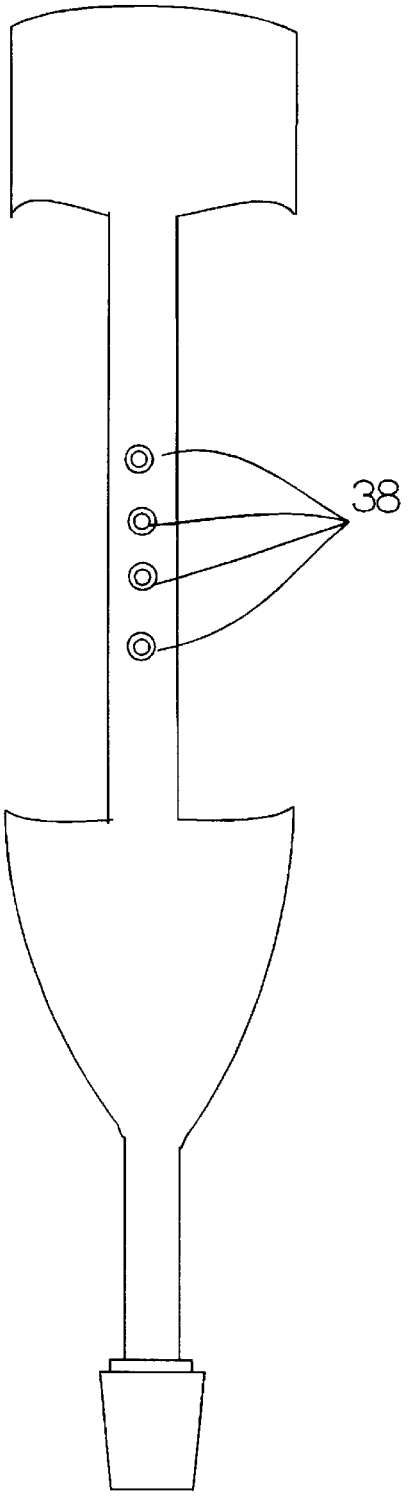
FIG. 7 is a view of the device of FIG. 1 turned 90°.

A handgrip 28 extends from one side of the frame 24 to the other side of the frame 24 and is positioned approximately the length of the forearm from the elbow end 30 of the frame. Each end pin 32 and 34 of the handgrip is inserted into a grommet 38 and 40 attached to opposite sides of the frame (FIG. 1, FIG. 6 and FIG. 7). The attachment means consisting of the series of grommets 38 and 40 allows the user to vary the distance of the handgrip from the forearm end of the frame 30 to accommodate individuals having different forearm lengths. The attachment means can be positioned in reinforcing strips 42 and 44 positioned on opposite sides of the frame 30. The attachment means includes resilient grommets 38 having radial openings 46 positioned on the inner side of frame 30 for the insertion of handle end pins 32 an 34. In another embodiment the reinforcing element can be slidably mounted in the frame and locked into place with screws or clamps. If the forearm assistant device is custom made for an individual, there is no need to adjust the distance of the handgrip from the forearm end of the device.

A cuff liner cushion 26 positioned on the inner surface of the cuff adjacent the forearm end of the device circles the arm of the user and extends at least two inches from the forearm end. The inner diameter of the cushion is preferably larger in diameter than the forearm of the user so as not to exert pressure on the forearm when the device is not in active use. Pressure on the forearm is intermittent when the device is in active use producing a massaging effect. The cushion 26 is preferably attached to the inner surface of the device with a VELCRO™ attachment.

The frame 30 is preferably made of a resilient material so as to protect the user in case of a fall or if the frame accidentally strikes something while the user is working. A shield can be positioned on the tool end of the frame if the user is working in brush or is subject to flying debris such as hot ashes from a fire. The device can also be used to work through a small opening in an enclosure.

Figure 9:
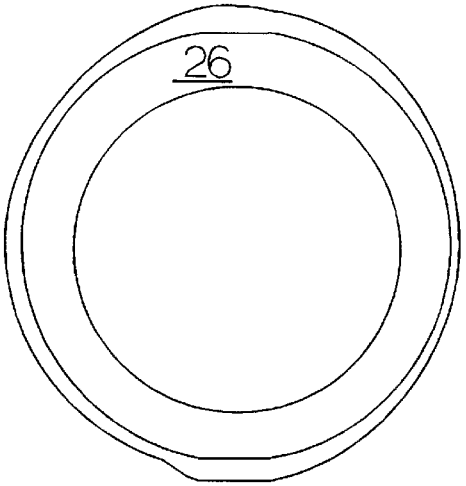
FIG. 9 is a view partially in section of the forearm assistant device of FIG. 8 showing the peg leg of the crutch attached to the locking device by a safety pin.
Figure 8:
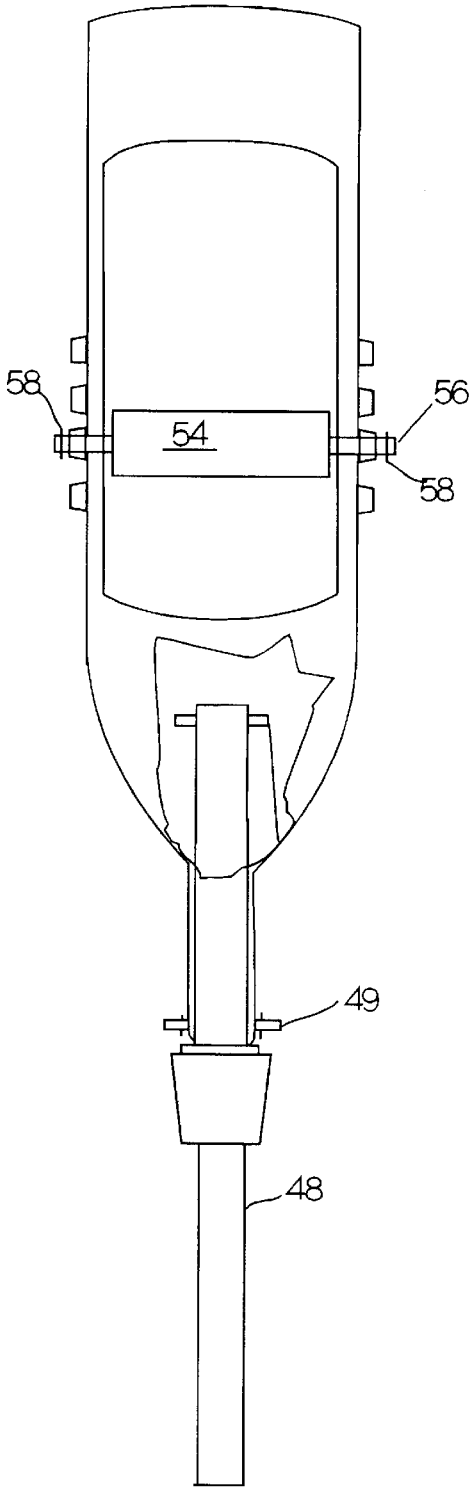
FIG. 8 is a view partially in section of the forearm assistant device having a different handle attachment and a safety wire when used as a forearm crutch.

The fore-arm assistant device of the present invention can also be used as a forearm crutch (See FIG. 8). When used as a forearm crutch a rod 48, which functions as a crutch leg, is firmly held in the tubular locking member 12. As a safety measure when used as a forearm crutch a common pin 49 extends though the rod 48, the frame 24 and a tubular extension 50 of the locking member 12 to ensure that the rod 48 does not slip in locking member 12 (See FIG. 9 which is a sectional view of FIG. 8). Also as a safety feature the tubular extension 50 of the locking member 12 is attached through pin 51 to the frame 24 with a safety wire 52 to prevent any possibility of the inner tubular extension 50 striking the hand of a user in case of the tubular extension 50 coming loose from the frame 24. The threaded tubular compressible end of the locking device 16 is joined to a glass fiber reinforced plastic tubular extension 50. The locking device is obtained from Structron, Inc and is called a STAYLOCK locking device. In the manufacture of the forearm assistant device, holes are drilled in the tubular extension 50 and the frame 24 is molded around the tubular extension tube. Material from the frame 24 flows into the holes in the tubular extension 50 to hold the tubular extension 50 in place.

Figure 10:
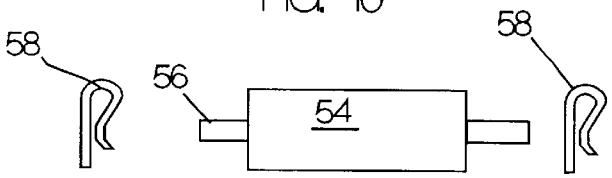
FIG. 10 is a the handgrip of the device of FIG. 8 in combination with the pins used to hold the handle in place.
Figure 9:
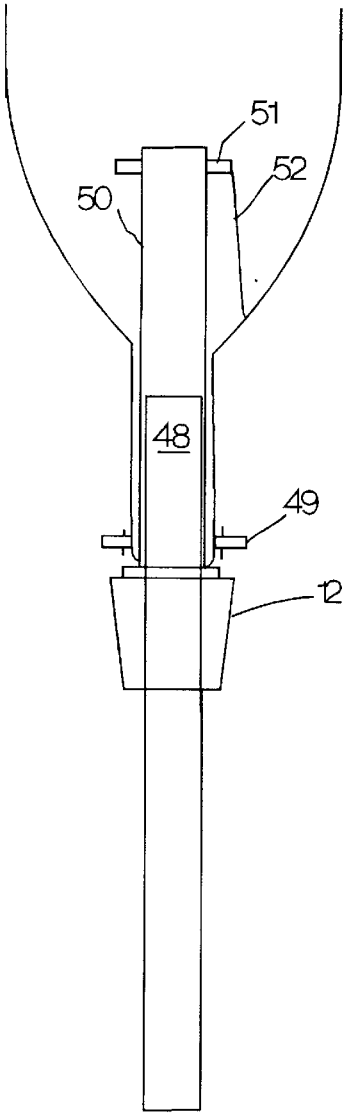

When using the forearm assistant device as a crutch a different hand grip 54 is preferably used. A rod 56 extends through hand grip 54. The rod 56 is held in place by pins 58 which extend through the ends of rod 56 (see FIG. 10).

Figure 11:
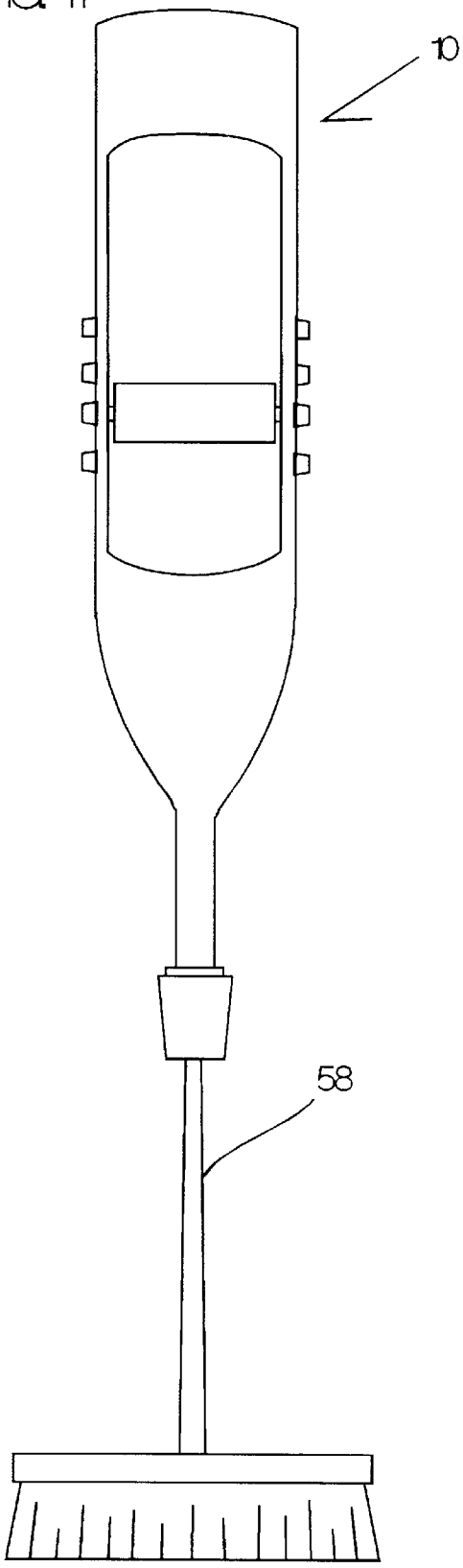
FIGS. 11—14 are views of different implements which can be used with one hand using the forearm assistant device of the present invention.
Figure 12:
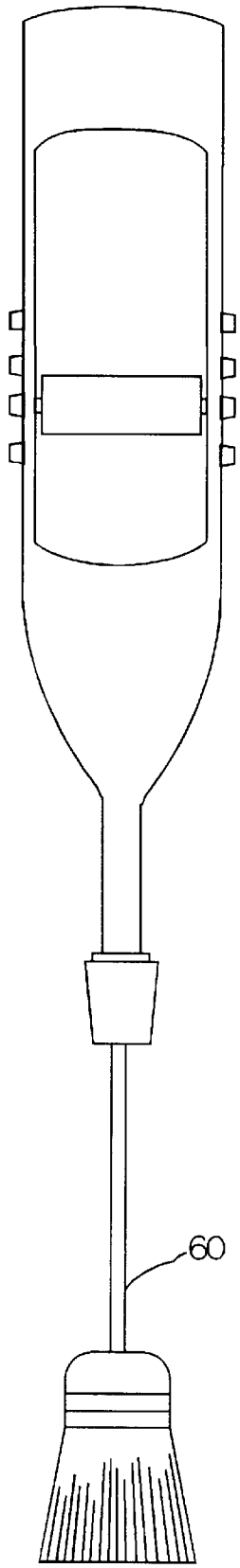
Figure 13:
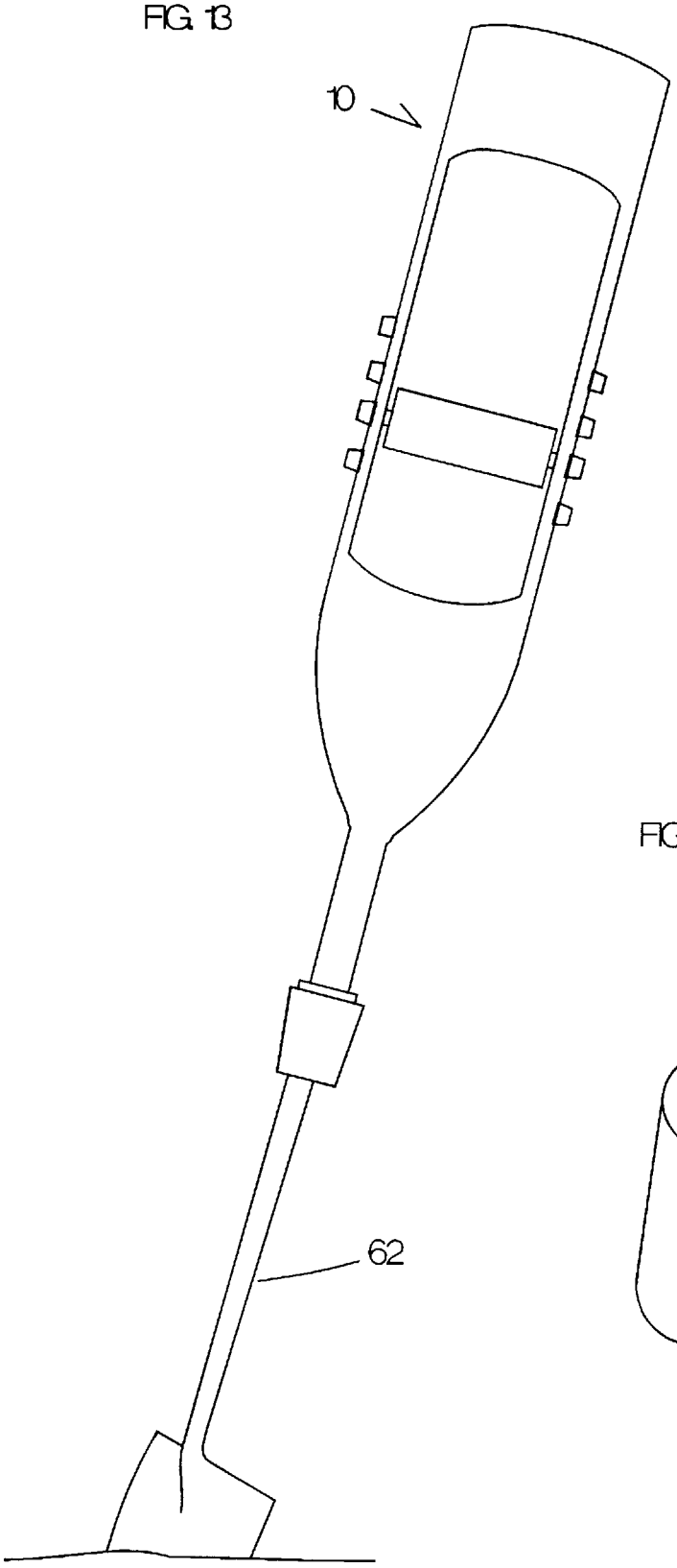

FIG. 11 shows a push broom 58 attached to the forearm assistant device 10. FIG. 12 shows a convention broom 60 attached to the forearm assistant device 10. FIG. 13 shows a spade 62 attached to the forearm assistant device 10. A tubular shim can be positioned between the locking device and a tool handle to compensate for diameter differences between the inner diameter of the tubular locking member and the outer diameter of the tool handle.

Figure 16:
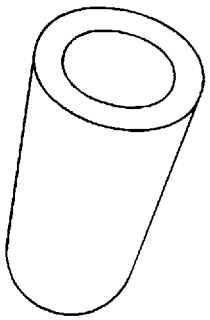
FIG. 16 is a view of a shim used when an implement handle has a diameter smaller than the inner diameter of the locking device.
Figure 14:
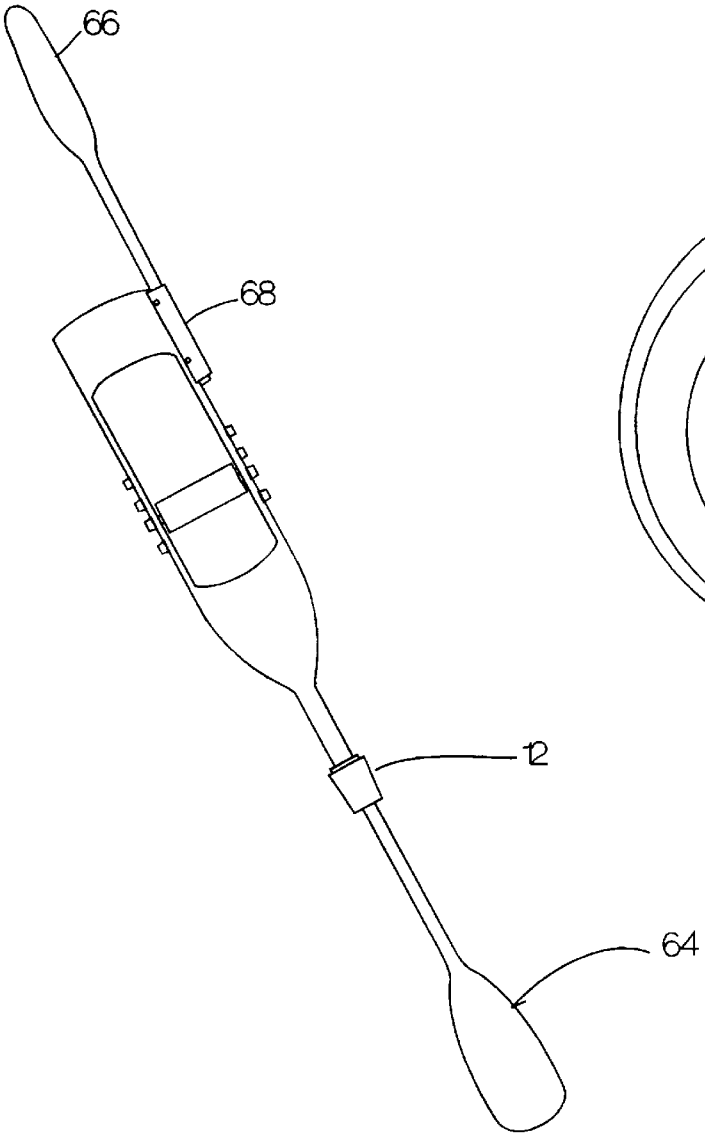
Figure 15:
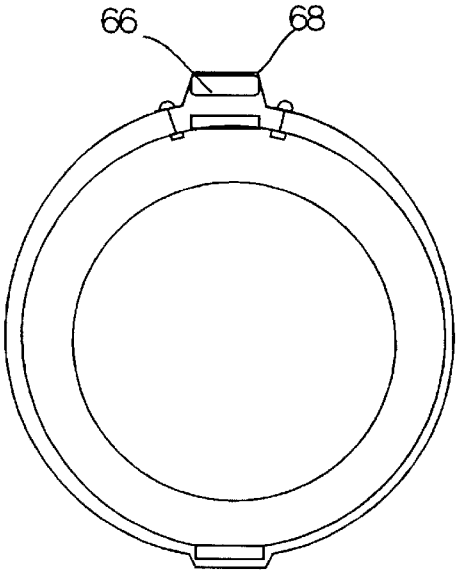
FIG. 15 is a sectional view of the cuff of the device showing a paddle handle attached by a bracket.

FIG. 14 shows the forearm assistant device 10 employed as part of a kayak oar. One paddle 64 is attached to the forearm assistant device 10 by tubular locking member 12. A second paddle 66 is attached to the forearm assistant device 10 by a clamp 68. FIG. 16 is a cross sectional view of the forearm assistant device 10 with the second paddle 66 attached by clamp 68. The blade of one paddle 64 is turned at a ninety degree angle from that of the second paddle 66.

FIG. 16 is a view of a shim that can be placed between a tool handle and tubular locking device 12 to compensate for diameter differences.

I claim:

1. A fore-arm assistant device comprising a one piece molded plastic frame, said frame having an open end for the insertion of a forearm of a user, a cuff integral with the frame, said cuff having a width of at least two inches positioned at the open end of a length of frame so as to completely encircle the forearm adjacent to an elbow of the user, a handgrip positioned in the frame between the cuff and an opposed end of the frame, and a tubular locking member positioned on the opposed end of the frame, said locking member having an inner tube wherein the inner tube is attached to the frame with a safety wire to prevent any possibility of the inner tube striking the hand of a user in case of the locking device coming loose from the frame.

2. The fore-arm assistant device of claim 1 having inner surface in the cuff wherein a cushion is positioned on the inner surface of the cuff adjacent the forearm end of the device and extends at least an inch from the forearm end of the device.

3. The fore-arm assistant device of claim 2 wherein the inner diameter of the cushion is greater than the outer diameter of the fore-arm so as not to constrict blood flow.

4. The fore-arm assistant device of claim 1 wherein the frame is made of a resilient material so as to protect the user in case of a fall.

5. The fore-arm assistant device of claim 1 wherein a tubular shim is positioned between an inner surface of the locking member and an outer surface of a tool handle to compensate for diameter differences.

6. The device of claim 1 wherein an extension tube is attached to the locking device, holes are positioned in the extension tube, and the frame is molded around the extension tube whereby material from the frame flows into the extension tube.

7. The device of claim 1 further characterized by a paddle held in the locking device, a clamp positioned on the frame, and a second paddle held onto the frame by the clamp.

8. A fore-arm assistant device comprising a one piece molded plastic frame having an open end for the insertion of a forearm of a user, a cuff integral with the frame, said cuff having a width of at least two inches positioned at the open end of a length of frame so as to completely encircle the forearm adjacent to an elbow of the user, a handgrip positioned in the frame between the cuff and an opposed end of the frame, and a tubular locking member positioned on the opposed end of the frame wherein the handgrip has two ends and each end of the handgrip is adjustably positionable with respect to the length of the frame to vary the distance of the handgrip from the cuff to accommodate individuals having different forearm lengths.

9. The fore-arm assistant device of claim 8 wherein reinforcing strips are positioned on opposite sides of the length of the frame and an attachment means for the handgrip is positioned in the reinforcement strips.

10. The fore-arm assistant device of claim 9 wherein the attachment means consists of resilient grommets having radial openings for the insertion of handgrip ends.

11. The fore-arm assistant device of claim 2 wherein a rod is firmly held in the tubular locking member to form a fore-arm crutch.

12. The fore-arm assistant device of claim 8 wherein a common pin extends through both the rod and the frame to ensure that the rod does not slip in the locking member.

* * * * *